US008651574B2

(12) United States Patent
Tranback

(10) Patent No.: US 8,651,574 B2
(45) Date of Patent: Feb. 18, 2014

(54) OFFICE CHAIR

(75) Inventor: Lennart Tranback, Nynäshamn (SE)

(73) Assignee: LT Office Line AB, Nynashamn (SE)

( * ) Notice: Subject to any disclaimer, the term of this patent is extended or adjusted under 35 U.S.C. 154(b) by 147 days.

(21) Appl. No.: 13/382,580

(22) PCT Filed: Jan. 21, 2010

(86) PCT No.: PCT/SE2010/050055

§ 371 (c)(1),
(2), (4) Date: Jan. 6, 2012

(87) PCT Pub. No.: WO2010/087760

PCT Pub. Date: Aug. 5, 2010

(65) Prior Publication Data

US 2012/0146375 A1 Jun. 14, 2012

(30) Foreign Application Priority Data

Jan. 29, 2009 (SE) ..... 0900088

(51) Int. Cl.
*A47C 3/00* (2006.01)

(52) U.S. Cl.
USPC ..... 297/284.4; 297/284.7

(58) Field of Classification Search
USPC ..... 297/284.4, 284.7, 300.2
See application file for complete search history.

(56) References Cited

U.S. PATENT DOCUMENTS 5,582,459 A * 12/1996 Hama et al. ..... 297/300.2
5,584,533 A * 12/1996 Schrewe ..... 297/300.2
5,810,440 A * 9/1998 Unwalla ..... 297/316
(Continued)

FOREIGN PATENT DOCUMENTS

WO WO 2008/018117 2/2008

OTHER PUBLICATIONS

International Search Report for PCT/SE2010/050055.

*Primary Examiner* — David R Dunn
*Assistant Examiner* — Alexander Harrison
(74) *Attorney, Agent, or Firm* — Stites & Harbison PLLC; Douglas E. Jackson

(57) ABSTRACT

An office chair (1) comprising a seat (2) and a backrest (3), wherein the backrest (3) includes a lumbar support (4), which is adjustable between an inactive position in which it follows the general shape of the backrest (3), and a fully active position in which it is curved outwards forwardly from the backrest (3) in order to support the lumbar back portion of a person seated on the seat (2) of the chair (1). The seat (2) is tillable about a first pivot point (A) between an initial position, and a slightly forwardly tilted second position, wherein the position of the seat is adjusted by means of the centre of gravity (G) of a person seated in the chair, such that when the centre of gravity (G) is behind the pivot point (A) the seat (2) rests in the first position and when the centre of gravity (G) is in front of the pivot point (A) the seat (2) rests in the second position, and in that the position of the lumbar support (4) is governed by the position of the seat (2) such that it is positioned in the inactive position when the seat (2) is in the initial position, and in the active position when the seat (2) rests in the tilted position, in order to support the lumbar back portion of a person seated on the seat (2) of the chair (1) when said person is leaning forwards.

4 Claims, 3 Drawing Sheets

(56) References Cited

U.S. PATENT DOCUMENTS

| | | | | |
|---|---|---|---|---|
| 6,000,755 | A * | 12/1999 | Uhlenbrock | 297/300.2 |
| 6,056,361 | A | 5/2000 | Cvek | |
| 6,805,405 | B2 * | 10/2004 | Koo | 297/284.7 |
| 7,625,045 | B2 * | 12/2009 | Hatcher et al. | 297/300.2 |
| 2008/0231095 | A1 * | 9/2008 | Brauning | 297/219.1 |
| 2009/0146476 | A1 * | 6/2009 | Kan et al. | 297/284.4 |
| 2009/0184553 | A1 * | 7/2009 | Dauphin | 297/284.4 |
| 2011/0101749 | A1 * | 5/2011 | Shih | 297/284.7 |
| 2012/0146376 | A1 * | 6/2012 | Kang et al. | 297/284.7 |

* cited by examiner

OFFICE CHAIR

FIELD OF THE INVENTION

The present invention relates to an office chair with tiltable seat and an adaptable lumbar support.

BACKGROUND OF THE INVENTION

Traditionally, office chairs have been constructed by men for men. Even though over the last decades women are just as common as men in offices, this is to a great extent still true. Most chairs are adaptable to fit persons of different length and different weight, but the main features are still adapted for men. This invention is based on extensive studies of ergonomics as well as physical and social factors, from which it has been determined that there are differences in the way women and men are sitting in office chairs.

In U.S. Pat. No. 6,805,405, an office chair is described in which a lumbar support is activated upon tilting of the back rest. This is useful for supporting the lumbar when the person sitting in the chair is leaning backwards, i.e. assumes a resting position.

However, in the research that was made it was discovered that persons working in an office chair, especially women, tend to lean forward when assuming an active position, for working on their desk or especially on their computer. With the conventional design of office chairs their backs will not be supported by the backrest in that active position. This is particularly true for short persons who due to obvious reasons are forced to sit on the front part of the seat. Thus, there is a need for a chair that offers support for the everyday working position for persons working in an office. The invention is based on this discovery and the inventive chair has been elaborated especially for women but can be made in any size and is not limited to fit persons of a certain size or figure.

SUMMARY OF THE INVENTION

An object of the invention is to provide a chair that is adapted to the everyday working position of persons working in an office.

The above-mentioned object is achieved by the present invention according to the claim 1.

According to a main aspect the invention relates to an office chair comprising a seat and a backrest, wherein the seat has a back part facing the backrest, and a front part directed forwardly away from the backrest, and wherein the backrest includes a lumbar support, which is adjustable between an inactive position in which it follows the general shape of the backrest, and a fully active position in which it is curved outwards forwardly from the backrest in order to support the lumbar back portion of a person seated on the seat of the chair. The seat is tiltable about a first pivot point between an initial position, and a slightly forwardly tilted second position, wherein the position of the seat is adjusted by means of the centre of gravity of a person seated in the chair, such that when the centre of gravity is behind the pivot point the seat rests in the first position and when the centre of gravity is in front of the pivot point the seat rests in the second position, and in that the position of the lumbar support is governed by the position of the seat such that it is positioned in the inactive position when the seat is in the initial position, and in the active position when the seat rests in the tilted position, in order to support the lumbar back portion of a person seated on the seat of the chair when said person is leaning forwards.

With the chair according to the invention the person sitting in the chair gets support for his or her back both in an upright conventional working position, but also in a position where he or she is leaning slightly forwards, e.g. for working at a desk or on a computer.

Preferred embodiments of the invention are set forth in the dependent claims and in the detailed description.

SHORT DESCRIPTION OF THE APPENDED DRAWINGS

DETAILED DESCRIPTION OF THE SHOWN EMBODIMENT OF THE INVENTION

Figure 1:
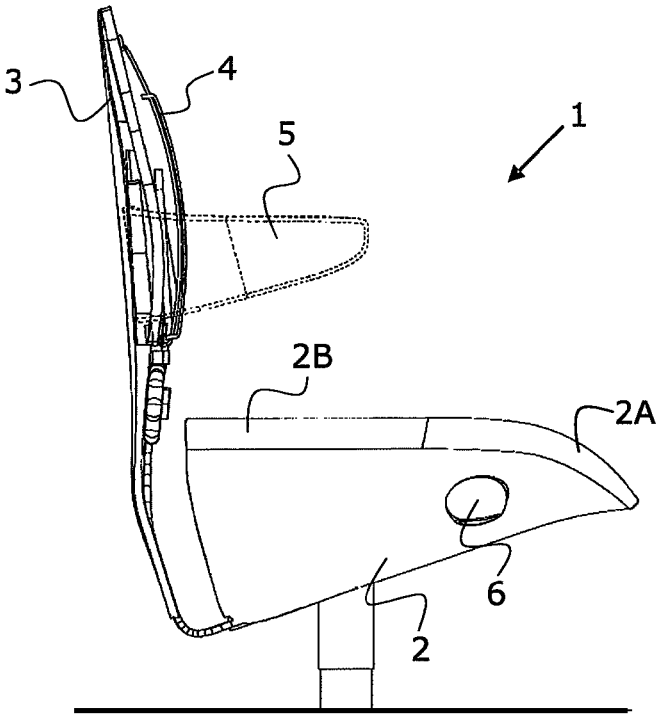
FIG. 1 shows a side view of an office chair according to one embodiment of the invention with the seat located in a normal position.
Figure 2:
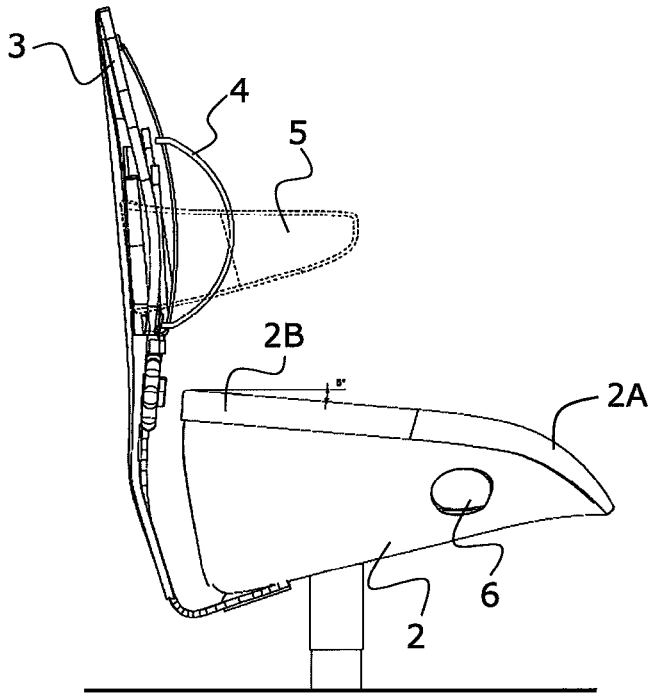
FIG. 2 shows a side view of the office chair with the seat located in a tilted position.

FIGS. 1 and 2 shows the general function of the office chair according to the shown embodiment of the invention.

The office chair 1 comprises a seat 2, a backrest 3, and armrests 5. The seat 2 has a back part 2B facing the backrest 3, and a front part 2A directed forwardly away from the backrest 3. The backrest 3 includes a lumbar support 4, which is adjustable between an inactive position (shown in FIG. 1) in which it follows the general shape of the backrest 3, and a fully active position (shown in FIG. 2) in which it is curved outwards forwardly from the backrest 3 in order to support the lumbar back portion of a person seated on the seat 2 of the chair 1.

Figure 3:
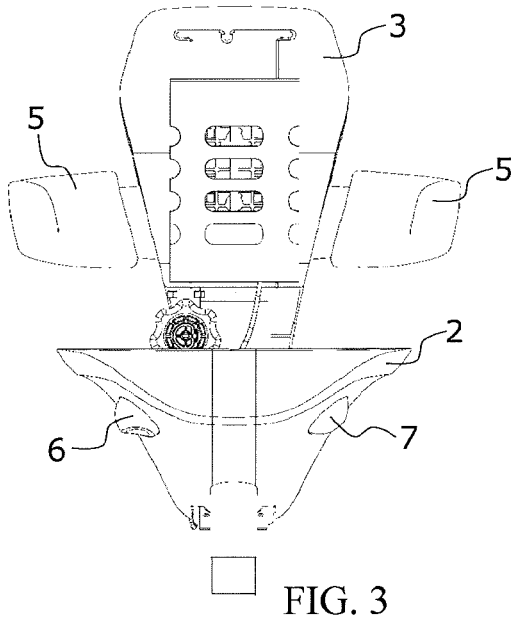
FIG. 3 shows a front view of the office chair.

A general object of the invention is to facilitate the manoeuvring of the chair's controls. This is inter alia achieved by the avoidance of levers. Thus instead of the conventional levers, the functions of the chair is controlled by the position of the person sitting in the chair and by two spherical controls 6, and 7, one on each side of the chair's seat, see FIG. 3. One of the spherical controls is arranged for regulating the height of the seat, and the other one is arranged to control the tilting of the backrest, preferably via a wire. Preferably, the backrest 3 may be regulated between e.g. 5 different tilting modes, a first working mode in which it may not be tilted at all or only very little, and stepwise up to a fifth tilting mode in which it may be tilted about 30° into a comfortable relaxing position.

An important feature of the invention is the function of the lumbar support 4. According to the invention the activation of the lumbar support 4 is governed by the position of the seat 2, which in turn is governed by the current position of the person sitting in the chair. In FIG. 1, the seat 2 is in a normal position and the lumbar support 4 is in its inactive position. In FIG. 2, the seat 2 has been tilted into a tilted position and the lumbar support 4 is in its active position.

The function of the lumbar support 4, will now be described with reference to FIGS. 4 and 5.

Figure 4:
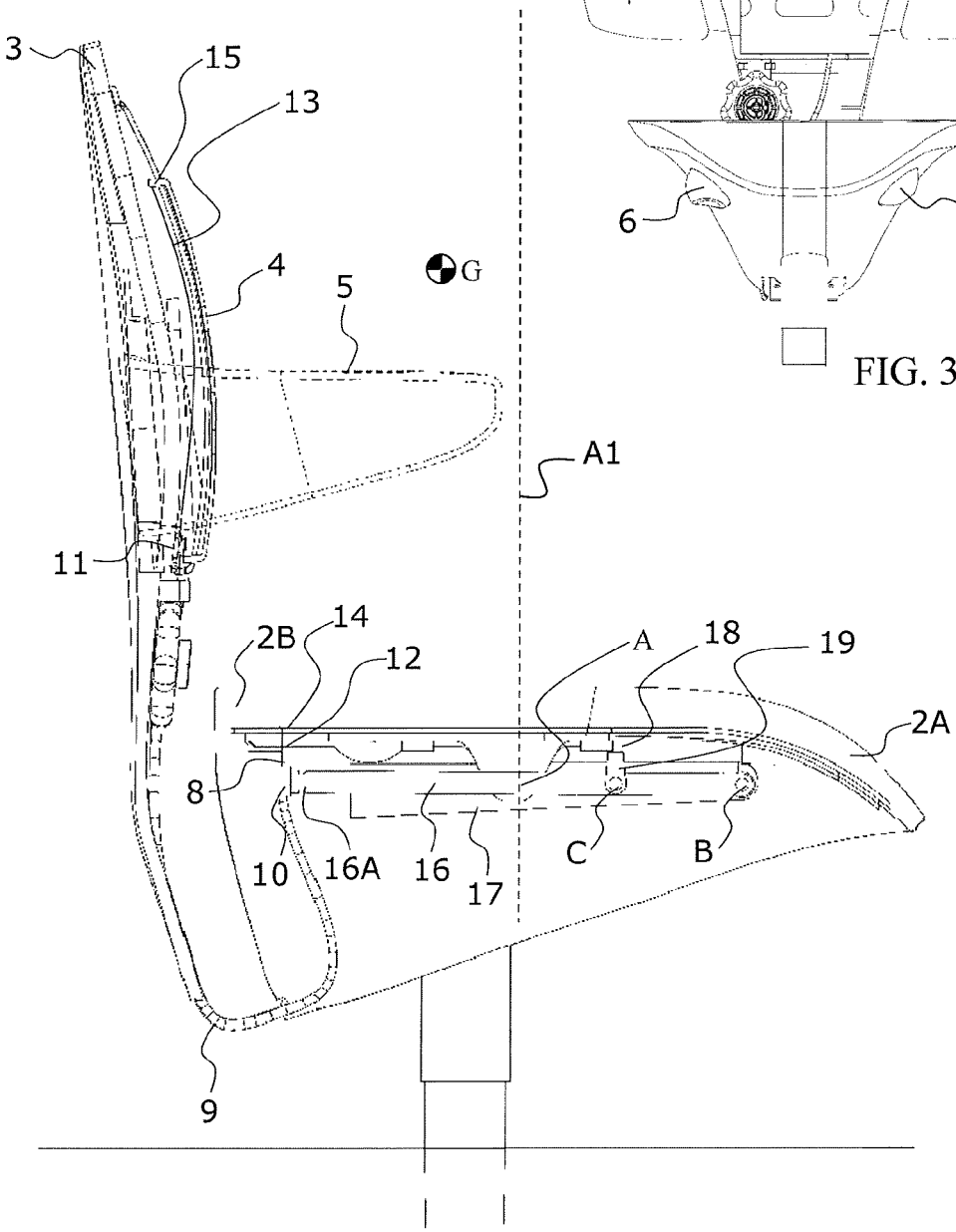
FIG. 4 shows a sectional view of the office chair from the side and with the seat located in a normal position.
Figure 5:
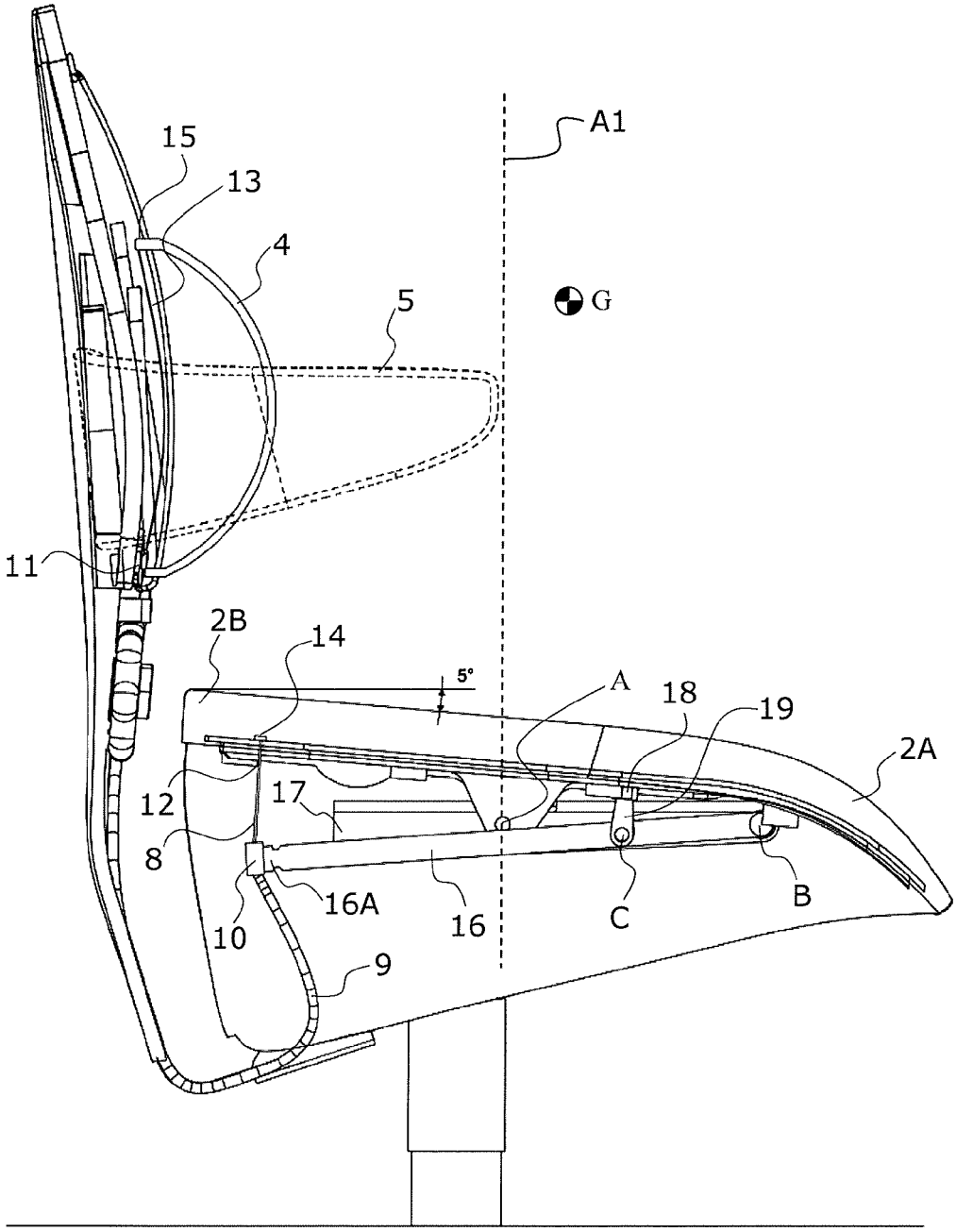
FIG. 5 shows a sectional view of the office chair from the side and with the seat located in a tilted position.

The seat 2 is tiltable about a first pivot point A between a first position or an initial position (shown in FIG. 4), and a second slightly forwardly tilted position (shown in FIG. 5). The position of the seat 2 is adjusted by means of the centre of gravity G of a person seated in the chair, such that when the centre of gravity G is located behind the first pivot point A the seat 2 is in the initial position, and when the centre of gravity G is in front of the pivot point A the seat 2 is transferred into the tilted position. In the figures, the centre of gravity G of the person seated in the chair is represented by a chequered dot, which is to be compared with a vertical line A1 corresponding to the vertical projection of the first pivot point A.

Further, as indicated above, the position of the lumbar support 4 is governed by the position of the seat 2 such that it is positioned in the inactive position (shown in FIG. 4) when the seat 2 is in the first position, and in the active position (shown in FIG. 5) when the seat 2 rests in the second position, in order to support the lumbar back portion of a person seated on the seat 2 of the chair 1 when said person is leaning forwards. This may in fact be realised in a number of ways that are obvious to a person skilled in the art once the object of the invention have been established.

In the office chair 1 in the shown embodiment a wire 8 is arranged between the seat 2 and the lumbar support 4, the wire 8 being arranged inside a rigid sheath 9 such that it is free to move co-axially inside the sheath 9, the sheath having two openings 10, 11, through which the ends 12, 13 of the wire 8 extends. A first opening 10 from which a first end 12 of the wire exits and attaches to a fixing point 14 on the underside of the back part 2B of the seat 2 and a fixed second opening 11 from which a second end 13 of the wire 8 exits and connects to an actuation pin 15 of the lumbar support 4. The function of the sheathed wire is similar to its function on a shoe brake, used e.g. on bikes.

When the seat 2 is tilted from the initial position of FIG. 4 into the tilted position of FIG. 5 the first end 12 of the wire is withdrawn from the first opening 10 of the sheath 9, which results in that the second end 13 of the wire 8 is pulled in through the second opening 11 of the sheath 9 such that it acts on the actuation means 15 of the lumbar support 4, to position the lumbar support in the active position. In order for this to work, the sheath openings 10, 11 need to restrict the sheath from moving with the wire 8. The easiest way to arrange this is of course to fix the openings 10 and 11 opposed to and in the vicinity of the respective fixture points 14, 15 of the wire ends 12, 13.

In the shown embodiment it is however desired to obtain relatively large response on the lumbar support 4 from a relatively small inclination or tilting of the seat 2, preferably less than 10° and typically in the range of 5°.

In order to accentuate the response, a lever 16 is used. The first opening 10 of the sheath 9 is arranged on a free end 16A of this lever 16, which is arranged to pivot about a second point (B). The second pivot point (B) is arranged on rigid stationary plate 17 on which also the first pivot point (A) is arranged. The second pivot point (B) is arranged on the front part 2A of the seat 2 in front of the first pivot point (A), which is arranged substantially in the middle of the seat 2. The lever 16 extends backwards from its pivot point B towards the back part 2B of the seat 2, where the first end 12 of the wire has its fixing point 14, such that the free end 16A of the lever 16 is located in alignment with the fixation point 14 of the first end 12 of the wire 8.

A connection point 18 on the seat 2 in front of the first pivot point A but behind the second pivot point B is connected by a connector 19 to an actuation point C on the lever 16. When the seat 2 is tilted into the tilted position, the connection point 18 and the connector 19 are forced downwards and acts on the actuation point C on the lever 16, such that the lever 16 is pivoted downwards. Due to this construction the free end 16A of the lever 16 is moved downwards at the same time as the fixing point 14 for the first end 12 of the wire 8 on the underside of the seat 2 is moved upwards. Hence, the length of the wire 8 that is withdrawn from the first sheath opening 10 is substantially doubled, which of course implies that the length of the wire 8 pulled in to the second sheath opening 11 is also doubled, such that double the support effect may be achieved by the lumbar support.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. An office chair comprising:

a seat and a backrest, wherein the seat has a back part facing the backrest, and a front part directed forwardly away from the backrest, and wherein the backrest includes a lumbar support, which is adjustable between an inactive position in which the lumbar support follows the general shape of the backrest, and a fully active position in which the lumbar support is curved outwards forwardly from the backrest in order to support the lumbar back portion of a person seated on the seat of the chair, wherein the seat is tiltable about a first pivot point between an initial position, and a slightly forwardly tilted second position, wherein the position of the seat is adjusted by the centre of gravity of a person seated in the chair, such that when the centre of gravity is behind the pivot point the seat rests in the first position and when the centre of gravity is in front of the pivot point the seat rests in the second position, and wherein the position of the lumbar support is governed by the position of the seat such that the lumbar support is positioned in the inactive position when the seat is in the initial position, and in the active position when the seat rests in the tilted position, in order to support the lumbar back portion of a person seated on the seat of the chair when said person is leaning forwards, wherein a wire is arranged between the seat and the lumbar support, the wire being arranged inside a rigid sheath such that the wire is free to move co-axially inside the sheath, wherein the sheath having two openings, a first opening from which a first end of the wire exits and attaches to a fixing point on the underside of the back part of the seat, and a fixed second opening from which a second end of the wire exits and connects to the lumbar support, wherein the first end of the wire is withdrawn from the first opening of the sheath as the seat is tilted into the tilted position, such that the second end of the wire is pulled in through the second opening such that the second end acts on the lumbar support, to position the lumbar support in the active position, wherein the first opening of the sheath is arranged on a free end of a lever, which lever is arranged to pivot about a second point in front of the first pivot point, which first pivot is arranged substantially in the middle of the seat, and wherein a connection point on the seat in front of the first pivot point but behind the second pivot point is connected by a connector to an actuation point on the lever, such that the lever is actuated downwards by the connector when the seat is tilted forward such that the free end of the lever is moved downwards at the same time as the fixing point for the first end of the wire on the underside of the back part of the seat is moved upwards, so as to substantially double the length of the wire that is withdrawn from the sheath.

2. The office chair of claim 1, wherein the tilting of the seat is limited to tilt maximally about 10°.

3. The office chair of claim 1, wherein the seat of the chair is pre-stressed into the initial position.

4. The office chair of claim 2, wherein the tilting of the seat is limited to tilt maximally only about 5°.

* * * * *